US005985135A

United States Patent [19]

Gupta

[11] Patent Number: 5,985,135

[45] Date of Patent: Nov. 16, 1999

[54] STAGED UPFLOW AND DOWNFLOW HYDROPROCESSING WITH NONCATALYTIC REMOVAL OF UPFLOW STAGE VAPOR IMPURITIES

[75] Inventor: Ramesh Gupta, Berkeley Heights, N.J.

[73] Assignee: Exxon Research and Engineering Co., Florham Park, N.J.

[21] Appl. No.: 09/177,734

[22] Filed: Oct. 23, 1998

[51] Int. Cl.[6] ..... C10G 25/00; C10G 17/00

[52] U.S. Cl. ..... 208/212; 208/210; 208/211; 208/213; 208/254 H; 203/DIG. 6

[58] Field of Search ..... 208/213, 254 H, 208/210, 211; 203/DIG. 6

[56] References Cited

U.S. PATENT DOCUMENTS 3,234,121 2/1966 MacLaren ..... 208/264
5,522,983 6/1996 Cash et al. ..... 208/59
5,705,052 1/1998 Gupta ..... 208/57
5,720,872 2/1998 Gupta ..... 208/57

*Primary Examiner*—Walter D. Griffin
*Assistant Examiner*—Tam M. Nguyen
*Attorney, Agent, or Firm*—Henry E. Naylor

[57] ABSTRACT

A hydroprocessing process for removing impurities from a feed comprising a hydrocarbonaceous liquid comprises at least one cocurrent, upflow hydroprocessing reaction stage, a vapor-liquid contacting stage and a downflow hydroprocessing reaction stage. The feed and hydrogen react in the upflow stage to produce a partially hydroprocessed liquid and vapor effluent. The vapor contacts a hydrocarbonaceous liquid in the contacting stage, which transfers impurities from the vapor into the liquid. The impurity-enriched contacting liquid mixes with the upflow stage liquid effluent and the combined liquid effluents react with hydrogen in the downflow reaction stage, to form a hydroprocessed product liquid and vapor effluent. Additional product liquid is recovered by cooling and condensing either or both the contacting and downflow stage vapor effluents.

19 Claims, 1 Drawing Sheet

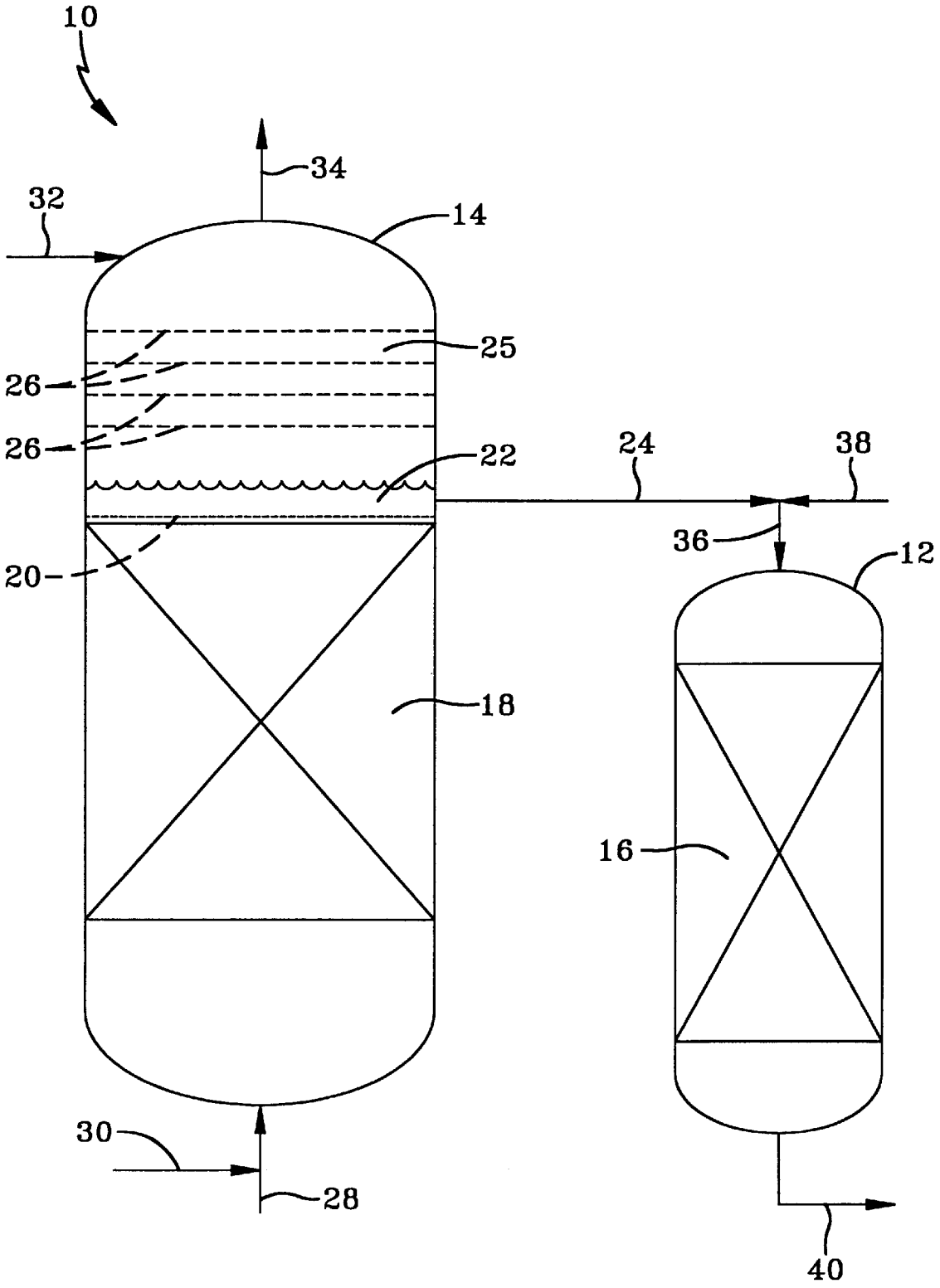
10
34
32
14
25
26
26
22
24
38
36
12
20
18
16
30
28
40

STAGED UPFLOW AND DOWNFLOW HYDROPROCESSING WITH NONCATALYTIC REMOVAL OF UPFLOW STAGE VAPOR IMPURITIES

BACKGROUND OF THE DISCLOSURE

1. Field of the Invention

The invention relates to hydroprocessing hydrocarbonaceous feeds in consecutive upflow and downflow reaction stages, with noncatalytic removal of impurities from the upflow stage vapor effluent. More particularly, the invention relates to a process for removing impurities from a hydrocarbonaceous feed, by catalytically hydroprocessing the feed in a cocurrent upflow first reaction stage, followed by a downflow reaction stage, with impurities removed from the upflow reaction stage vapor effluent, by contacting it with a hydrocarbonaceous liquid. Feed impurities, such as heteroatom (e.g., sulfur) compounds, present in the upflow reaction stage vapor effluent, are transferred to the hydrocarbonaceous liquid by the contacting. The contacting liquid is then combined with the upflow stage liquid effluent and hydroprocessed in the second stage. The impurity-reduced vapor is cooled to condense and recover additional product liquid.

2. Background of the Invention

As supplies of lighter and cleaner feeds dwindle, the petroleum industry will need to rely more heavily on relatively high boiling feeds derived from such materials as coal, tar sands, shale oil, and heavy crudes, all of which typically contain significantly more undesirable components, especially from an environmental point of view. These components include halides, metals, unsaturates and heteroatoms such as sulfur, nitrogen, and oxygen. Furthermore, due to environmental concerns, specifications for fuels, lubricants, and chemical products, with respect to such undesirable components, are continually becoming tighter. Consequently, such feeds and product streams require more upgrading in order to reduce the content of such undesirable components and this increases the cost of the finished products.

In a hydroprocessing process, at least a portion of the heteroatom compounds are removed, the molecular structure of the feed is changed, or both occur by reacting the feed with hydrogen in the presence of a suitable hydroprocessing catalyst. Hydroprocessing includes hydrogenation, hydrocracking, hydrotreating, hydroisomerization and hydrodewaxing, and therefore plays an important role in upgrading petroleum streams to meet more stringent quality requirements. For example, there is an increasing demand for improved heteroatom removal, aromatic saturation and boiling point reduction. In order to achieve these goals more economically, various process configurations have been developed using primarily downflow or trickle bed reactors, including the use of multiple hydroprocessing stages as is disclosed, for example, in U.S. Pat. Nos. 5,522,983; 5,705,052 and 5,720,872. Downflow trickle bed reactors must be designed with a high liquid mass velocity (liquid flow per cross-sectional area) to achieve good contacting of the catalyst with the liquid. This requires the cross-sectional area of the reactor to be small and therefore limited as to the amount of catalyst that it can hold, without the reactor being prohibitively high (e.g., ≧~100 ft.). With an existing trickle bed hydroprocessing unit, in order to enable processing of dirtier feeds, increase the feed capacity, increase the purity of the hydroprocessed product, or all three, additional reaction stages must be added. For example, to achieve ultra clean diesel fuel in a preexisting plant, multiple trickle bed reactors would need to be added in series. In addition to the high cost, such a multiple reactor plant would also be hydraulically limited, due to the high pressure drop of the multiple, tall reactors in series. It would be an improvement to the art if either one or all of the above could be accomplished with the addition of only a single reaction vessel containing no more than one or two additional reaction stages. It would be particularly advantageous if this could be achieved without either the pressure drop or need for a tall reaction vessel, that would be required with the addition of more trickle bed reaction stages.

SUMMARY OF THE INVENTION

The invention relates to removing impurities from a hydrocarbonaceous feed, by catalytically hydroprocessing the feed in consecutive upflow and downflow catalytic reaction stages, with noncatalytic removal of impurities from the upflow reaction stage vapor effluent, by vapor-liquid contacting. In the process of the invention, the impurity-containing feed is catalytically hydroprocessed in a first reaction stage, which is a cocurrent upflow reaction stage. The upflow stage produces a partially hydroprocessed vapor and liquid effluent, which contain feed impurities. Feed impurities are removed from the vapor by contacting it with a hydrocarbonaceous contacting liquid, under conditions effective for transferring impurities from the vapor into the liquid. This produces a clean vapor and an impurity-containing hydrocarbonaceous contacting liquid. The contacting is achieved in a countercurrent or crosscurrent flow contacting stage or zone, comprising vapor-liquid contacting media, in which the vapor flows up and the liquid down. In a preferred embodiment, the contacting stage includes internal refluxing for maximum removal of impurities from the vapor. The partially hydroprocessed first stage liquid effluent is combined with the impurity-containing hydrocarbonaceous contacting liquid, to form a mixture of both liquids. This liquid mixture is then hydroprocessed in the downflow stage and the liquid effluent from the downflow stage comprises the product liquid. The downflow reaction stage is a trickle bed comprising hydroprocessing catalyst. In the downflow reaction stage, the hydrocarbonaceous feed, which comprises both the upflow reaction stage liquid effluent and the contacting stage liquid effluent, flows down over the catalyst. The hydrogen treat gas in the downflow reaction stage flows cocurrently downward with the liquid. The downflow stage effluent comprises hydroprocessed liquid and vapor. The downflow reaction stage liquid effluent comprises the hydroprocessed product liquid. The downflow reaction stage vapor effluent will typically and preferably be cooled to condense out hydroprocessed hydrocarbonaceous compound vapors, as additional product liquid. The clean vapor effluent from the contacting stage is cooled to condense and recover additional hydroprocessed liquid, which may or may not be combined with the second stage liquid effluent as additional product liquid. In a preferred embodiment, the contacting liquid comprises either or both upflow and downflow stage liquid effluents, as is explained in detail below. The contacting liquid may also be obtained by cooling the vapor effluent from the upflow stage. The hydroprocessing and contacting remove feed impurities, such as heteroatom (e.g., sulfur) compounds or other undesirable components, initially present in the feed to be hydroprocessed. The second stage effluent comprises hydroprocessed vapor and liquid which have an impurity level lower than that of the feed and corresponding first or upflow stage effluents. As is the case for a trickle bed reaction stage, an upflow reaction stage comprises a bed of hydroprocessing catalyst. In an upflow reaction stage, both the liquid and hydrogen treat gas flow cocurrently up through the catalyst bed, which operates as a flooded bed (i.e., filled with liquid). A flooded bed means that substantially all of the catalyst particles are in contact with the liquid reactant. This permits as much as a 20–30 wt. % reduction in the amount of catalyst needed, compared to a trickle bed. Further, the use of one or more upflow reaction stages in a shorter, but wider vessel than that used with downflow trickle bed reactors, avoids the higher pressure drop that would be encountered with a trickle bed reactor having the same capacity. This process enables (i) the capacity of an existing downflow trickle bed hydroprocessing unit to be increased, (ii) a dirtier feed used and (iii) permits a cleaner product to be achieved with less catalyst and a shorter reactor, than that required for a conventional trickle bed reactor. In a preferred embodiment, the vapor-liquid contacting stage is located in the upflow bed reaction vessel, disposed above the upflow reaction stage or stages.

The first reaction stage liquid and vapor effluents are in equilibrium with each other, with respect to the impurity level in each phase. Accordingly, therefore, by hydrocarbonaceous contacting liquid is meant a hydrocarbonaceous liquid which preferably has an impurity level no greater, and more preferably less, than that present in the first stage liquid effluent. If the impurity level in the contacting liquid is the same, or greater than, that in the first stage liquid effluent, then the contacting liquid is cooled prior to contact with the first stage vapor, in order to transfer impurities from the vapor into the liquid. It is particularly preferred that the impurity level in the contacting liquid be less than that in the first stage liquid effluent and that the contacting liquid temperature be below that of the first stage vapor effluent, prior to the contacting. This assures more efficient and greater impurity transfer, from the vapor to the liquid. In the reaction stages, the hydrocarbonaceous feed is reacted with hydrogen in the presence of a suitable hydroprocessing catalyst at reaction conditions sufficient to achieve the desired hydroprocessing. The hydrogen is hydrogen gas, which may or may not be mixed or diluted with other gas and vapor components that do not adversely effect the reaction, products or process. If the hydrogen gas contains other such components, it is often referred to as hydrogen treat gas. If fresh hydrogen or substantially pure hydrogen is available, it is preferred that it be used at least in the downflow reaction stage. At least a portion, and more typically most (e.g., >50 wt. %) of the hydrocarbonaceous material being hydroprocessed in each stage is liquid at the reaction conditions. The hydroprocessing results in a portion of the liquid in each stage being converted to vapor. In most cases the hydrocarbonaceous material will comprise hydrocarbons.

Thus, the invention comprises a staged hydroprocessing process comprising at least one cocurrent upflow hydroprocessing reaction stage, at least one vapor-liquid contacting stage and at least one downflow hydroprocessing reaction stage, for removing one or more impurities from a feed comprising a hydrocarbonaceous liquid, which process comprises the steps of:

(a) reacting said feed with hydrogen in a cocurrent, upflow hydroprocessing reaction stage, which comprises the first reaction stage, in the presence of a hydroprocessing catalyst at reaction conditions effective to form a first stage effluent having a lower impurity content than said feed, said effluent comprising a first stage hydroprocessed hydrocarbonaceous liquid and vapor, both of which still contain said impurities, said vapor containing hydroprocessed hydrocarbonaceous feed components, with said impurities in equilibrium between said liquid and vapor effluents;

(b) separating said first stage liquid and vapor effluents;

(c) contacting said vapor effluent, in a contacting stage, with a hydrocarbonaceous liquid, under conditions such that impurities in said vapor transfer to said liquid, to form a contacting stage effluent comprising a hydrocarbonaceous liquid of increased impurity content and a vapor comprising hydroprocessed hydrocarbonaceous feed components having an impurity content less than that of said first stage vapor effluent;

(d) combining said first and contacting stage liquid effluents and passing them into a downflow hydroprocessing reaction stage, and (e) reacting said combined liquid effluents with hydrogen in said downflow hydroprocessing reaction stage, in the presence of a hydroprocessing catalyst at reaction conditions effective to form a downflow reaction stage effluent comprising a hydroprocessed hydrocarbonaceous liquid and a vapor comprising hydroprocessed hydrocarbonaceous feed components, wherein said liquid and vapor feed components have an impurity content lower than said feed and respective upflow stage effluents.

The downflow stage liquid effluent, which may require stripping, comprises hydroprocessed product liquid. Both the contacting stage and downflow reaction stage vapor effluents will preferably be cooled to condense a portion of the vapors to liquid, which is then separated from the remaining vapor. The liquid condensate may be combined with the downflow stage liquid, as additional product liquid, if desired. The second stage vapor and liquid effluents may be separated prior to cooling the vapor and condensing out additional product liquid or they may both be cooled together and the remaining vapor then separated from the combined liquid. Still further, if desired, the contacting stage vapor effluent may be combined with either the downflow stage vapor effluent or the downflow stage vapor and liquid effluents, prior to cooling and condensation of the clean hydrocarbonaceous components. A specific example of this process is a hydrotreating process for removing heteroatom impurities, such as sulfur, nitrogen and oxygenate compounds, from feeds such as middle distillate fuel fractions, and heavier feeds. It being understood, however, that the invention is not limited to a hydrotreating process. This is explained in detail below. Further, and as a practical matter, the vapor effluent from each reaction stage will also contain unreacted hydrogen.

BRIEF DESCRIPTION OF THE DRAWINGS

The FIGURE schematically illustrates a flow diagram of an embodiment of the invention, in which both the cocurrent upflow and vapor contacting stages are in a single reaction vessel, upstream of the downflow reaction vessel.

DETAILED DESCRIPTION

By hydroprocessing is meant a process in which hydrogen reacts with a hydrocarbonaceous feed to remove one or more impurities, to change or convert the molecular structure of at least a portion of the feed, or both. An illustrative, but non-limiting example of impurities may include (i) heteroatom impurities such as sulfur, nitrogen, and oxygen, (ii) ring compounds such as aromatics, condensed aromatics and other cyclic unsaturates, (iii) metals, (iv) other unsaturates, (v) waxy materials and the like. Thus, by impurity is meant any feed component which it is desired to remove from the feed by the hydroprocessing. Illustrative, but non-limiting examples of hydroprocessing processes which can be practiced by the present invention include forming lower boiling fractions from light and heavy feeds by hydrocracking; hydrogenating aromatics and other unsaturates; hydroisomerization and/or catalytic dewaxing of waxes and waxy feeds, and demetallation of heavy streams. Ring-opening, particularly of naphthenic rings, can also be considered a hydroprocessing process. By hydrocarbonaceous feed is meant a primarily hydrocarbon material obtained or derived from crude petroleum oil, from tar sands, from coal liquefaction, shale oil and hydrocarbon synthesis. The reaction stages used in the practice of the present invention are operated at suitable temperatures and pressures for the desired reaction. For example, typical hydroprocessing temperatures will range from about 40° C. to about 450° C. at pressures from about 50 psig to about 3,000 psig, preferably 50 to 2,500 psig. The first reaction stage vapor effluent may contain impurities or undesirable feed components, such as sulfur or other heteroatom compounds, which it is desired to remove from the first stage vapor. The hydrocarbonaceous contacting liquid will have an impurity concentration no greater, and preferably lower, than the impurity concentration in the first stage liquid effluent which is in equilibrium with the first stage vapor. While this contacting liquid may be any hydrocarbonaceous liquid which does not adversely affect either the process, or the desired hydroprocessed product liquid, and into which the vapor impurities will transfer, it will more typically comprise either or both the first and second reaction stage liquid effluents. Preferably it will be cooled to a temperature lower than the first stage vapor effluent, prior to the contacting. While a lower impurity concentration in the liquid will result in transfer of some impurities into it from the first stage vapor, having the contacting liquid at a temperature lower than that of the vapor, will result in transfer of more impurities, than if it was at the same temperature as the vapor. In a hydrotreating process, some of the sulfur and nitrogen hydrocarbon compound impurities that were present in the feed transfer to the upflow stage vapor effluent. After these impurities are removed from the vapor, by contacting it with the contacting liquid, the contacting stage vapor effluent will contain $H_2S$ and $NH_3$ formed by the hydroprocessing reactions, along with unreacted hydrogen and lighter hydrocarbon compounds.

Feeds suitable for use in such systems include those ranging from the naphtha boiling range to heavy feeds, such as gas oils and resids. Non-limiting examples of such feeds which can be used in the practice of the present invention include vacuum resid, atmospheric resid, vacuum gas oil (VGO), atmospheric gas oil (AGO), heavy atmospheric gas oil (HAGO), steam cracked gas oil (SCGO), deasphalted oil (DAO), light cat cycle oil (LCCO), natural and synthetic feeds derived from tar sands, shale oil, coal liquefaction, hydrocarbons synthesized from a mixture of $H_2$ and CO via a Fischer-Tropsch type of hydrocarbon synthesis, and mixtures thereof.

For purposes of hydroprocessing and in the context of the invention, the terms "hydrogen" and "hydrogen-containing treat gas" are synonymous and may be either pure hydrogen or a hydrogen-containing treat gas which is a treat gas stream containing hydrogen in an amount at least sufficient for the intended reaction, plus other gas or gasses (e.g., nitrogen and light hydrocarbons such as methane) which will not adversely interfere with or affect either the reactions or the products. Impurities, such as $H_2S$ and $NH_3$ are undesirable and, if present in significant amounts, will normally be removed from the treat gas, before it is fed into the reactor. The treat gas stream introduced into a reaction stage will preferably contain at least about 50 vol. %, more preferably at least about 75 vol. % hydrogen. In operations in which unreacted hydrogen in the vapor effluent of any particular stage is used for hydroprocessing in any stage, there must be sufficient hydrogen present in the fresh treat gas introduced into that stage, for the vapor effluent of that stage to contain sufficient hydrogen for the subsequent stage or stages. It is preferred in the practice of the invention, that all or a portion of the hydrogen required for the first stage hydroprocessing be contained in the second stage vapor effluent fed up into the first stage. The second stage vapor effluent will be cooled to condense and recover the hydrotreated and relatively clean, heavier (e.g., $C_4$–$C_{5+}$) hydrocarbons. The remaining hydrogen-containing vapor, may then be recycled back into the upflow stage, as hydrogen treat gas.

The invention can be further understood with reference to the FIGURE, which is a schematic flow diagram of an embodiment of the invention, in which both the cocurrent upflow and vapor contacting stages are in a single reaction vessel, upstream of the downflow reaction vessel. In this particular embodiment, the hydroprocessing process is a hydrotreating process and the reaction stages hydrotreating stages. For the sake of simplicity, not all process reaction vessel internals, valves, pumps, heat transfer devices etc. are shown. Thus, a hydrotreating unit 10, for hydrotreating a petroleum and heteroatom containing distillate or diesel fuel hydrocarbon feed, comprises hollow, cylindrical, metal reactor vessels 12 and 14, containing respective fixed beds 16 and 18 within, each comprising a particulate hydrotreating catalyst. Reactor vessel 12 operates as a downflow, trickle bed reactor and may have comprised an older hydrotreating unit, retrofitted with an upflow reaction vessel 14, to increase both the capacity of the unit and the purity of the hydrotreated product. Catalyst bed 16 comprises a downflow reaction stage, while catalyst bed 18 comprises an upflow reaction stage. Each reaction stage produces a hydrotreated effluent comprising liquid and vapor, with the effluent from the upflow reaction stage, which is the first hydrotreating stage, only partially hydrotreated. Stage separation means 20, is disposed over the upflow catalyst bed 18, to separate the upflow reaction stage from the vapor-liquid contacting stage and also separates the upflow stage gas and liquid effluents. Separation means 20 comprises a gas permeable tray means. Such trays means are known in the art and typically comprise a metal disk provided with a plurality of pipes extending therethrough, a bubble cap tray and the like. The liquid effluent collects as a liquid layer, is drawn off via line 24 and passed to vessel 12. A vapor-liquid contacting stage 25, comprising vapor-liquid contacting means 26 indicated by the dashed lines, is shown disposed above the upflow hydrotreating stage 18. The feed to be hydrotreated enters the first stage reaction vessel 14, under the catalyst bed 18, via line 28. Hydrogen gas, or a hydrogen-containing treat gas, is introduced into the bottom of the reactor along with the feed, via lines 30 and 28. As mentioned above, it is preferred that this gas comprise at least 50% hydrogen gas for the upflow reaction stage and, for the downflow stage, it is preferred that it comprise at least 75% hydrogen gas. The hydrogen gas for the upflow stage may be obtained from the downflow stage vapor effluent, after hydrocarbon removal, provided the downflow stage pressure is sufficiently higher than that in the upflow reaction stage. The feed and hydrogen flow cocurrently up into and through catalyst bed 18, which contains a sulfur tolerant catalyst, in which the feed reacts with the hydrogen in the presence of the catalyst, to remove feed impurities. In the case of hydrotreating, these impurities comprise oxygenates, sulfur and nitrogen compounds, olefins and aromatics. The hydrogen reacts with the impurities to convert them to $H_2S$, $NH_3$, and water vapor, which are removed as part of the vapor effluent, and it also saturates olefins and aromatics. This forms a first or upflow stage effluent comprising a mixture of partially hydrotreated hydrocarbon liquid and vapor, with the vapor containing vaporized feed components, unreacted hydrogen, $H_2S$ and $NH_3$. As those skilled in the art know, in hydrotreating and other hydroprocessing processes, the amount of hydrogen passed into a hydroprocessing reaction stage is in excess of that amount theoretically required to achieve the desired degree of conversion. This is done to maintain a sufficient hydrogen partial pressure throughout the reaction zone. Therefore, the vapor effluent from each hydroprocessing reaction zone will contain the unreacted hydrogen. Most (e g., ≧50%) of the feed hydrotreating is accomplished in the first stage. In two stage hydrotreating processes, it is not unusual for 60%, 75% and even ≧90% of the heteroatom (S, N and O) compounds in the feed to be removed from the liquid in the first stage, by converting them to $H_2S$, $NH_3$, and $H_2O$. Therefore, the second stage catalyst can be a more kinetically active, but less sulfur tolerant, catalyst than the first stage catalyst for heteroatom removal, and in addition can also achieve greater aromatics saturation. In this embodiment the first or upflow stage catalyst may comprise cobalt and molybdenum catalytic components supported on alumina, and the second, or downflow stage catalyst may comprise nickel-molybdenum or nickel-tungsten catalytic metal components on an alumina support. Since the first stage vapor and liquid effluents are in equilibrium with respect to the feed impurities and the feed is only partially hydrotreated, some feed impurities are also present in the first stage liquid and vapor effluents. The first stage vapor effluent separates from the partially hydrotreated liquid effluent and passes up into contacting stage 25. Hydrocarbon contacting liquid is introduced into vessel 14, above the top of the contacting means of the contacting stage, via line 32. As the first reaction stage vapor effluent flows up through the contacting means, it is contacted by the downflowing liquid under conditions effective for transferring at least a portion of the feed impurities in the vapor into the liquid. The contacting means comprises any known vapor-liquid contacting means, such as rashig rings, berl saddles, wire mesh, ribbon, open honeycomb, gas-liquid contacting trays, such as bubble cap trays and other devices, etc. In the embodiment shown in the FIGURE, the dashed lines shown as the contacting means 26, represent gas-liquid contacting trays. Conditions effective for impurity transfer from the vapor to the contacting liquid include, a combination of temperatures and impurity concentrations conducive to transferring the desired amount of impurities from the vapor into the liquid. If the downflowing liquid has an impurity concentration greater than what it would be if the liquid and vapor were in equilibrium prior to contacting, with respect to the impurity concentrations, then the contacting liquid is at a temperature sufficiently lower than that of the vapor, to achieve the desired transfer. Preferably the impurity concentration in the contacting liquid is less than the equilibrium concentration, and more preferably the liquid is also at a lower temperature than the vapor. The temperature of the contacting liquid introduced into the contacting stage is determined by the vapor temperature, and the relative concentrations, solubilities and condensation temperatures of the heteroatom compounds in each phase. The combination of temperatures and concentrations is such as to transfer the desired amount of these feed impurity compounds to the liquid by absorption, condensation and equilibrium concentration differentials, to achieve the desired vapor purity. While any suitable hydrocarbon liquid can be used, it is preferred that at least a portion of the contacting liquid comprise at least one of the upflow and downflow reaction stage liquid effluents. More preferably it will comprise the downflow stage liquid effluent, which has an impurity concentration below that of the upflow stage liquid effluent. The impurity-reduced vapor is removed from the top of the reactor via line 34. This vapor is preferably cooled to condense the heavier (e.g., $C_{4+}$–$C_{5+}$) hydrotreated vapor hydrocarbon components to liquid, which is separated from the remaining vapor, with this liquid then combined with the hydrotreated downflow stage liquid effluent as additional product liquid, if desired. This condensed and recovered hydrotreated liquid may require stripping to remove any remaining $H_2S$ and $NH_3$. The vapor remaining after cooling and condensation will comprise mostly methane and unreacted hydrogen, along with the $H_2S$ and $NH_3$ formed by the hydroprocessing reaction. The impurity-increased contacting liquid passes down onto the top of the tray means 20, where it combines and mixes with the upflow reaction stage liquid effluent. The combined liquids form a layer above the first stage, as indicated in the FIGURE, are withdrawn via line 24 and passed into the top of vessel 12, via line 36. Fresh hydrogen or a treat gas comprising hydrogen, is passed into vessel 12, via lines 38 and 36. The combined liquid and hydrogen pass cocurrently down through the downflow hydrotreating reaction stage 16. During the downflow stage hydrotreating, most of the heteroatom compounds in the combined liquid are removed, with the $H_2S$ and $NH_3$ formed by the hydrotreating passing into the vapor. The downflow stage hydrotreating reaction produces a hydrotreated liquid and vapor effluent, which pass down and out of the vessel via line 40. The second stage vapor effluent comprises mostly unreacted hydrogen, along with methane and minor amounts of $H_2S$ and $NH_3$. The downflow stage liquid effluent comprises the hydrotreated product liquid and is separated from the downflow stage vapor effluent either before or after the second stage vapor effluent is cooled to condense out hydrotreated hydrocarbons as additional product liquid. The product liquid will typically be sent to stripping, to remove any $H_2S$ and $NH_3$. The contacting stage and downflow stage vapor effluents may be combined and cooled to condense out additional product liquid, either separate from, or in the presence of, the downflow stage liquid effluent.

Those skilled in the art will appreciate that the invention can be extended to more than two reaction and one contacting stages. Thus, one may also employ three or more reaction stages in which the partially processed liquid effluent from the first stage is the second stage feed, the second stage liquid effluent is the third stage feed, and so on, with attendant vapor stage contacting in one or more liquid-vapor contacting stages. Thus there may be more than one upflow reaction stage and more than one downflow reaction stages. If more than one of either or both types of reaction stages is employed, than a single reaction vessel may contain more than one upflow reaction stages or they may be in separate vessels. Thus, the invention will relate to at least one upflow reaction stage and at least one downflow reaction stage. By reaction stage is meant at least one catalytic reaction zone in which the liquid, or mixture of liquid and vapor reacts with hydrogen in the presence of a suitable hydroprocessing catalyst to produce an at least partially hydroprocessed effluent. The catalyst in an upflow reaction zone of the invention is typically in the form of a fixed bed. More than one catalyst can also be employed in a particular zone as a mixture or in the form of layers (for a fixed bed).

The term "hydrotreating" as used herein refers to processes wherein a hydrogen-containing treat gas is used in the presence of a suitable catalyst which is primarily active for the removal of heteroatoms, such as sulfur, and nitrogen, non-aromatics saturation and, optionally, saturation of aromatics. Suitable hydrotreating catalysts for use in a hydrotreating embodiment of the invention include any conventional hydrotreating catalyst. Examples include catalysts comprising of at least one Group VIII metal catalytic component, preferably Fe, Co and Ni, more preferably Co and/or Ni, and most preferably Co; and at least one Group VI metal catalytic component, preferably Mo and W, more preferably Mo, on a high surface area support material, such as alumina. Other suitable hydrotreating catalysts include zeolitic catalysts, as well as noble metal catalysts where the noble metal is selected from Pd and Pt. The Groups referred to herein are those found in the Periodic Table of the Elements, copyrighted in 1968 by the Sargent-Welch Scientific Company. As mentioned above, it is within the scope of the present invention that more than one type of hydrotreating catalyst may be used in the same reaction stage or zone. Typical hydrotreating temperatures range from about 100° C. to about 400° C. with pressures from about 50 psig to about 3,000 psig, preferably from about 50 psig to about 2,500 psig. If one of the reaction stages is a hydrocracking stage, the catalyst can be any suitable conventional hydrocracking catalyst run at typical hydrocracking conditions. Typical hydrocracking catalysts are described in U.S. Pat. No. 4,921,595, the disclosure of which is incorporated herein by reference. Such catalysts are typically comprised of a Group VIII metal hydrogenating component on a zeolite cracking base. Hydrocracking conditions include temperatures from about 200° to 425° C.; a pressure of about 200 psig to about 3,000 psig; and liquid hourly space velocity from about 0.5 to 10 V/V/Hr, preferably from about 1 to 5 V/V/Hr. Non-limiting examples of aromatic hydrogenation catalysts include nickel, cobalt-molybdenum, nickel-molybdenum, and nickel-tungsten. Noble metal (e.g., platinum and/or palladium) containing catalysts can also be used. The aromatic saturation zone is preferably operated at a temperature from about 40° C. to about 400° C., more preferably from about 260° C. to about 350° C., at a pressure from about 100 psig to about 3,000 psig, preferably from about 200 psig to about 1,200 psig, and at a liquid hourly space velocity (LHSV) of from about 0.3 V/V/Hr. to about 2 V/V/Hr.

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A staged hydroprocessing process comprising at least one cocurrent upflow hydroprocessing reaction stage, at least one vapor-liquid contacting stage and at least one downflow hydroprocessing reaction stage, for removing one or more impurities from a feed comprising a hydrocarbonaceous liquid, which process comprises the steps of:

(a) reacting said feed with hydrogen in a cocurrent, upflow hydroprocessing reaction stage, which comprises the first reaction stage, in the presence of a hydroprocessing catalyst at reaction conditions effective to form a first stage effluent having a lower impurity content than said feed, said effluent comprising a first stage hydroprocessed hydrocarbonaceous liquid and vapor, both of which still contain said impurities, said vapor containing hydroprocessed hydrocarbonaceous feed components, with said impurities in equilibrium between said liquid and vapor effluents;

(b) separating said first stage liquid and vapor effluents;

(c) contacting said vapor effluent, in a contacting stage, with a hydrocarbonaceous liquid, under conditions such that impurities in said vapor transfer to said liquid, to form a contacting stage effluent comprising a hydrocarbonaceous liquid of increased impurity content and a vapor comprising hydroprocessed hydrocarbonaceous feed components having an impurity content less than that of said first stage vapor effluent;

(d) combining said first stage hydroprocessed hydrocarbonaceous liquid and contacting stage liquid effluents and passing them into a downflow hydroprocessing reaction stage, and (e) reacting said combined liquid effluents with hydrogen in said downflow hydroprocessing reaction stage, in the presence of a hydroprocessing catalyst at reaction conditions effective to form a downflow reaction stage effluent comprising a hydroprocessed hydrocarbonaceous liquid and a vapor comprising hydroprocessed hydrocarbonaceous feed components, wherein said liquid and vapor feed components have an impurity content lower than said feed and respective upflow stage effluents.

2. A process according to claim 1 wherein said upflow and downflow reaction stage catalysts are the same or different.

3. A process according to claim 2 wherein said downflow stage liquid effluent comprises product liquid.

4. A process according to claim 3 wherein said contacting conditions comprise at least one of (i) said contacting liquid being at a temperature below that of said vapor, and (ii) said contacting liquid impurity content being below what it would be, if said liquid was in equilibrium concentration with said vapor, with respect to said impurity concentration.

5. A process according to claim 4 wherein said contacting stage vapor effluent is cooled to condense a portion of said hydrocarbonaceous components to liquid.

6. A process according to claim 5 wherein said contacting liquid is cooled to a temperature below that of said vapor before said contacting.

7. A process according to claim 4 wherein said contacting stage includes internal reflux.

8. A process according to claim 5 wherein said downflow reaction stage vapor effluent is cooled to condense a portion of said hydroprocessed hydrocarbonaceous components to liquid.

9. A process according to claim 8 wherein said upflow reaction stage and said contacting stage are in the same reaction vessel.

10. A staged hydrotreating process comprising at least one cocurrent upflow hydrotreating reaction stage, at least one vapor-liquid contacting stage and at least one downflow hydrotreating reaction stage, for removing one or more impurities comprising heteroatom compounds and unsaturates from a feed comprising a hydrocarbon liquid, which comprises the steps of:

(a) reacting said feed with hydrogen in a cocurrent, upflow hydrotreating reaction stage, which comprises the first reaction stage, in the presence of a hydrotreating catalyst at reaction conditions effective to form a first stage effluent having a lower impurity content than said feed, said effluent comprising a first stage hydrotreated hydrocarbon liquid and vapor, both of which still contain said impurities, said vapor containing hydrotreated hydrocarbon feed components, with said impurities in equilibrium between said liquid and vapor effluents;

(b) separating said first stage liquid and vapor effluents;

(c) contacting said vapor effluent, in a contacting stage, with a hydrocarbon liquid, under conditions such that impurities in said vapor transfer to said liquid, to form a contacting stage effluent comprising a hydrocarbon liquid of increased impurity content and a vapor comprising hydrotreated hydrocarbon feed components having an impurity content less than that of said first stage vapor effluent;

(d) combining said first stage hydroprocessed hydrocarbonaceous liquid and contacting stage liquid effluents and passing them into a downflow hydrotreating reaction stage, and (e) reacting said combined liquid effluents with hydrogen in said downflow hydrotreating reaction stage, in the presence of a hydrotreating catalyst at reaction conditions effective to form a downflow reaction stage effluent comprising a hydrotreated hydrocarbon liquid and a vapor comprising hydrotreated hydrocarbon feed components, wherein said liquid and vapor feed components have an impurity content lower than said feed and respective upflow stage effluents.

11. A process according to claim 10 wherein said upflow and downflow reaction stage catalysts are the same or different.

12. A process according to claim 11 wherein said downflow reaction stage liquid effluent comprises product liquid.

13. A process according to claim 12 wherein said contacting conditions comprise at least one of (i) said contacting temperature being below that of said vapor, and (ii) said contacting liquid impurity content being below what it would be, if said liquid was in equilibrium concentration with said vapor, with respect to said impurity concentration.

14. A process according to claim 13 wherein said contacting stage vapor effluent is cooled to condense a portion of said hydrocarbon components to liquid.

15. A process according to claim 14 wherein said contacting liquid is cooled to a temperature below that of said vapor before said contacting.

16. A process according to claim 13 wherein said contacting stage includes internal reflux.

17. A process according to claim 13 wherein said downflow reaction stage vapor effluent is cooled to condense a portion of said hydrotreated hydrocarbon components to liquid.

18. A process according to claim 14 wherein said upflow reaction stage and said contacting stage are in the same reaction vessel.

19. A process according to claim 18 wherein said contacting stage is disposed above said upflow reaction stage.

* * * * *